US008702969B2

(12) United States Patent
Tasaka et al.

(10) Patent No.: US 8,702,969 B2
(45) Date of Patent: Apr. 22, 2014

(54) HYDROCRACKING PROCESS AND PROCESS FOR PRODUCING HYDROCARBON OIL

(75) Inventors: Kazuhiko Tasaka, Tokyo (JP); Yuichi Tanaka, Tokyo (JP); Marie Iwama, Tokyo (JP)

(73) Assignees: Japan Oil, Gas and Metals National Corporation, Tokyo (JP); Inpex Corporation, Tokyo (JP); JX Nippon Oil & Energy Corporation, Tokyo (JP); Japan Petroleum Exploration Co., Ltd., Tokyo (JP); Cosmo Oil Co., Ltd., Tokyo (JP); Nippon Steel Engineering Co., Ltd., Tokyo (JP)

( * ) Notice: Subject to any disclaimer, the term of this patent is extended or adjusted under 35 U.S.C. 154(b) by 34 days.

(21) Appl. No.: 13/395,264

(22) PCT Filed: Sep. 14, 2010

(86) PCT No.: PCT/JP2010/065860
§ 371 (c)(1),
(2), (4) Date: Mar. 9, 2012

(87) PCT Pub. No.: WO2011/034064
PCT Pub. Date: Mar. 24, 2011

(65) Prior Publication Data

US 2012/0168349 A1 Jul. 5, 2012

(30) Foreign Application Priority Data

Sep. 16, 2009 (JP) ..... 2009-214907

(51) Int. Cl.
*C10G 47/02* (2006.01)

(52) U.S. Cl.
USPC ..... 208/108; 208/100; 208/62; 208/63; 208/65; 208/66

(58) Field of Classification Search
USPC ..... 208/100, 62, 63, 64, 65, 66, 108
See application file for complete search history.

(56) References Cited

U.S. PATENT DOCUMENTS 3,497,449 A * 2/1970 Urban ..... 208/108
2004/0256287 A1 12/2004 Miller et al.

FOREIGN PATENT DOCUMENTS

CN 1814703 A 8/2006
CN 101177619 A 5/2008

(Continued)

OTHER PUBLICATIONS

Chinese Office Action dated Nov. 5, 2013 issued in corresponding Chinese Application No. 201080040837.9 (with English Translation).

(Continued)

*Primary Examiner* — Randy Boyer
*Assistant Examiner* — Juan Valencia
(74) *Attorney, Agent, or Firm* — Kenyon & Kenyon LLP

(57) ABSTRACT

A hydrocracking process that includes a wax fraction hydrocracking step of hydrocracking the wax fraction contained within a Fischer-Tropsch synthetic oil to obtain a hydrocracked product, a gas-liquid separation step of using a multi-stage gas-liquid separator to separate the hydrocracked product into a gas component, a heavy oil component and a light oil component, a specific component content estimation step of determining the flow rate ratio between the heavy oil component and the light oil component, and using this flow rate ratio to determine an estimated value for the content of a specific hydrocarbon component contained within the hydrocracked product, and a control step of controlling the operation of the wax fraction hydrocracking step on the basis of this estimated value, so that the content of the specific hydrocarbon component falls within a predetermined range.

6 Claims, 3 Drawing Sheets

(56) References Cited

FOREIGN PATENT DOCUMENTS

| | | |
|---|---|---|
| JP | 2004-323626 | 11/2004 |
| JP | 2007-520582 | 7/2007 |

OTHER PUBLICATIONS

International Search Report dated Oct. 12, 2010 issued in corresponding PCT Application No. PCT/JP2010/065860.

* cited by examiner

HYDROCRACKING PROCESS AND PROCESS FOR PRODUCING HYDROCARBON OIL

TECHNICAL FIELD

The present invention relates to a hydrocracking process for hydrocracking a wax fraction contained within a synthetic oil produced by a Fischer-Tropsch synthesis reaction, and also relates to a process for producing a hydrocarbon oil.

This application is a national stage application of International Application No. PCT/JP2010/065860, filed Sep. 14, 2010, which claims priority to Japanese Patent Application No. 2009-214907, filed Sep. 16, 2009, the content of which is incorporated herein by reference.

BACKGROUND ART

In recent years, the desire to reduce environmental impact has resulted in growing demands for clean liquid fuels that contain minimal amounts of sulfur and aromatic hydrocarbons and are gentle on the environment. As a result of these demands, processes that employ a Fischer-Tropsch synthesis reaction (hereafter abbreviated as "FT synthesis reaction"), which uses a gas containing carbon monoxide gas and hydrogen gas as a feedstock, have begun to be investigated as potential processes that are capable of producing fuel oil base stocks that contain minimal sulfur and aromatic hydrocarbons and are rich in aliphatic hydrocarbons, and particularly kerosene and gas oil base stocks (for example, see Patent Document 1).

The liquid hydrocarbons (raw oil) obtained by the FT synthesis reaction is a mixture containing mainly aliphatic hydrocarbons having a very broad carbon number distribution. From this liquid hydrocarbons can be obtained a naphtha fraction containing a large amount of components having a boiling point lower than approximately 150° C., a middle distillate containing a large amount of components having a boiling point within a range from approximately 150° C. to approximately 360° C., and a wax fraction (hereafter also referred to as the "FT wax fraction") containing those hydrocarbon components heavier than the middle distillate (namely, components having a boiling point that exceeds approximately 360° C.). Of these fractions, the middle distillate is the most useful fraction, being equivalent to a kerosene and gas oil base stock, and it is desirable to achieve a high yield of this middle distillate. Accordingly, in an upgrading step used for obtaining fuel oil base stocks from the liquid hydrocarbons, the FT wax fraction, which is produced in a reasonably large amount together with the middle distillate during the FT synthesis reaction step, is subjected to hydrocracking to reduce the molecular weight and convert the wax fraction components to components equivalent to the middle distillate, thereby increasing the overall yield of the middle distillate.

Specifically, the FT wax fraction that is obtained from the liquid hydrocarbons by fractional distillation is subjected to hydrocracking in a wax fraction hydrocracking step, and subsequently undergoes gas-liquid separation in a gas-liquid separation step. The thus obtained liquid component is fed into a later stage fractionator together with the middle distillate, which has previously been fractionally distilled from the liquid hydrocarbons and subjected to a separate hydrotreating, and the combined fractions are then subjected to fractional distillation to obtain a kerosene and gas oil base stock.

CITATION LIST

Patent Document

[Patent Document 1] Japanese Patent Unexamined Publication No. 2004-323626

SUMMARY OF INVENTION

Technical Problem

However, in the wax fraction hydrocracking step, if the hydrocracking proceeds excessively, then the resulting hydrocracked products are not produced as components equivalent to the middle distillate, but rather undergo further lightening, resulting in a reduction in the yield of the targeted middle distillate. On the other hand, if the hydrocracking does not progress sufficiently, then the yield of the middle distillate does not improve sufficiently.

Accordingly, it is necessary to ascertain the degree to which the hydrocracking is progressing in the wax fraction hydrocracking step, and then appropriately control this degree of hydrocracking progression to achieve a high yield of the middle distillate.

Conventionally, the hydrocracked product produced in the wax fraction hydrocracking step is sampled and analyzed by distillation gas chromatography, the content of a specific hydrocarbon component contained within the hydrocracked product is determined, and this content is used as an indicator to ascertain whether or not the hydrocracking is progressing sufficiently.

Specifically, the hydrocarbon component having a boiling point of not lower than 25° C. but not higher than 360° C. within the hydrocracked product is designated as the specific hydrocarbon component, the content (mass %) of this specific hydrocarbon component is determined based on the combined mass of all the hydrocracked products having a boiling point of 25° C. temperature or higher, and if the determined content falls within a predetermined range, then the degree of progression of the hydrocracking is deemed to be maintained at an appropriate level. On the other hand, if the content of the specific hydrocarbon component falls outside the predetermined range, then the conditions of the wax fraction hydrocracking step, namely the operating conditions of the hydrocracking apparatus, are altered appropriately, and the degree of progression of the hydrocracking is controlled to ensure that the content of the specific hydrocarbon component falls within the predetermined range.

However, when the hydrocracked product of a FT wax fraction having a broad carbon number distribution is analyzed by distillation gas chromatography, a single analysis requires a considerable length of time, and the frequency of analyses that can be performed using a single analysis apparatus is, at best, one analysis every hour and a half. Accordingly, with this type of conventional process, determining the degree of progression of the hydrocracking in "real time", and then controlling the hydrocracking operation in a rapid and appropriate manner in accordance with this real time determination is essentially impossible.

In the present description, unless stated otherwise, the expression "hydrocracked product" refers to the entire outflow from the wax fraction hydrocracking step, which includes not only hydrocarbon components of which the molecular weight has fallen below a predetermined level as a result of the hydrocracking, but also components for which hydrocracking has not proceeded sufficiently, which are referred to as "uncracked wax."

The present invention has been developed in light of the above circumstances, and has an object of providing a hydrocracking process in which the content of a specific hydrocarbon component within the hydrocracked product from the wax fraction hydrocracking step can be determined rapidly, and the degree of progression of the hydrocracking can then be controlled rapidly and appropriately on the basis of this determined content, as well as providing a process for producing a hydrocarbon oil.

Solution to Problem

The inventors of the present invention focused their attention on a process in which, by employing a multi-stage gas-liquid separator that performs gas-liquid separation of the hydrocracked product of a wax fraction, a heavy oil component and a light oil component are obtained as liquid components from the hydrocracked product, and also investigated the respective production rates of the heavy oil component and the light oil component. Then, by investigating these production rates and the aforementioned content of a specific hydrocarbon component within the hydrocracked product, the inventors discovered a correlation between these two factors, and were therefore able to complete the present invention.

In other words, a hydrocracking process of the present invention includes a wax fraction hydrocracking step of hydrocracking the wax fraction contained within liquid hydrocarbons synthesized by a Fischer-Tropsch synthesis reaction, thereby obtaining a hydrocracked product, a gas-liquid separation step of using a multi-stage gas-liquid separator to separate the hydrocracked product into a gas component, a heavy oil component and a light oil component, a specific component content estimation step of determining the flow rate ratio between the heavy oil component and the light oil component, and using this flow rate ratio to determine an estimated value for the content of a specific hydrocarbon component contained within the hydrocracked product, and a control step of controlling the operation of the wax fraction hydrocracking step on the basis of this estimated value, so that the content of the specific hydrocarbon component falls within a predetermined range.

A process for producing a hydrocarbon oil according to the present invention includes a liquid hydrocarbon synthesis step of synthesizing liquid hydrocarbons from a feedstock gas containing carbon monoxide gas and hydrogen gas by a Fischer-Tropsch synthesis reaction, a wax fraction hydrocracking step of hydrocracking the wax fraction contained within the liquid hydrocarbons synthesized in the liquid hydrocarbon synthesis step, thereby obtaining a hydrocracked product, a gas-liquid separation step of using a multi-stage gas-liquid separator to separate the hydrocracked product into a gas component, a heavy oil component and a light oil component, a specific component content estimation step of determining the flow rate ratio between the heavy oil component and the light oil component, and using this flow rate ratio to determine an estimated value for the content of a specific hydrocarbon component contained within the hydrocracked product, and a control step of controlling the operation of the wax fraction hydrocracking step on the basis of this estimated value, so that the content of the specific hydrocarbon component falls within a predetermined range.

The specific hydrocarbon component mentioned above may be the hydrocarbon component having a boiling point within a range from 25 to 360° C.

Further, the multi-stage gas-liquid separator may include a first gas-liquid separator, a cooling device that cools the gas component separated by the first gas-liquid separator and liquefies at least a portion of the gas component, and a second gas-liquid separator that performs a gas-liquid separation of the outflow from the cooling device, wherein the heavy oil component described above is the liquid component obtained from the first gas-liquid separator, and the light oil component described above is the liquid component obtained from the second gas-liquid separator.

Advantageous Effects of Invention

According to the present invention, the content of a specific hydrocarbon component within the hydrocracked product from a wax fraction hydrocracking step can be determined rapidly, and the degree of progression of the hydrocracking can then be controlled rapidly and appropriately on the basis of this determined content, and moreover, a middle distillate can be obtained stably and with a high yield from liquid hydrocarbons obtained by the FT synthesis reaction.

DESCRIPTION OF EMBODIMENTS

A more detailed description of the present invention is presented below.

Figure 1:
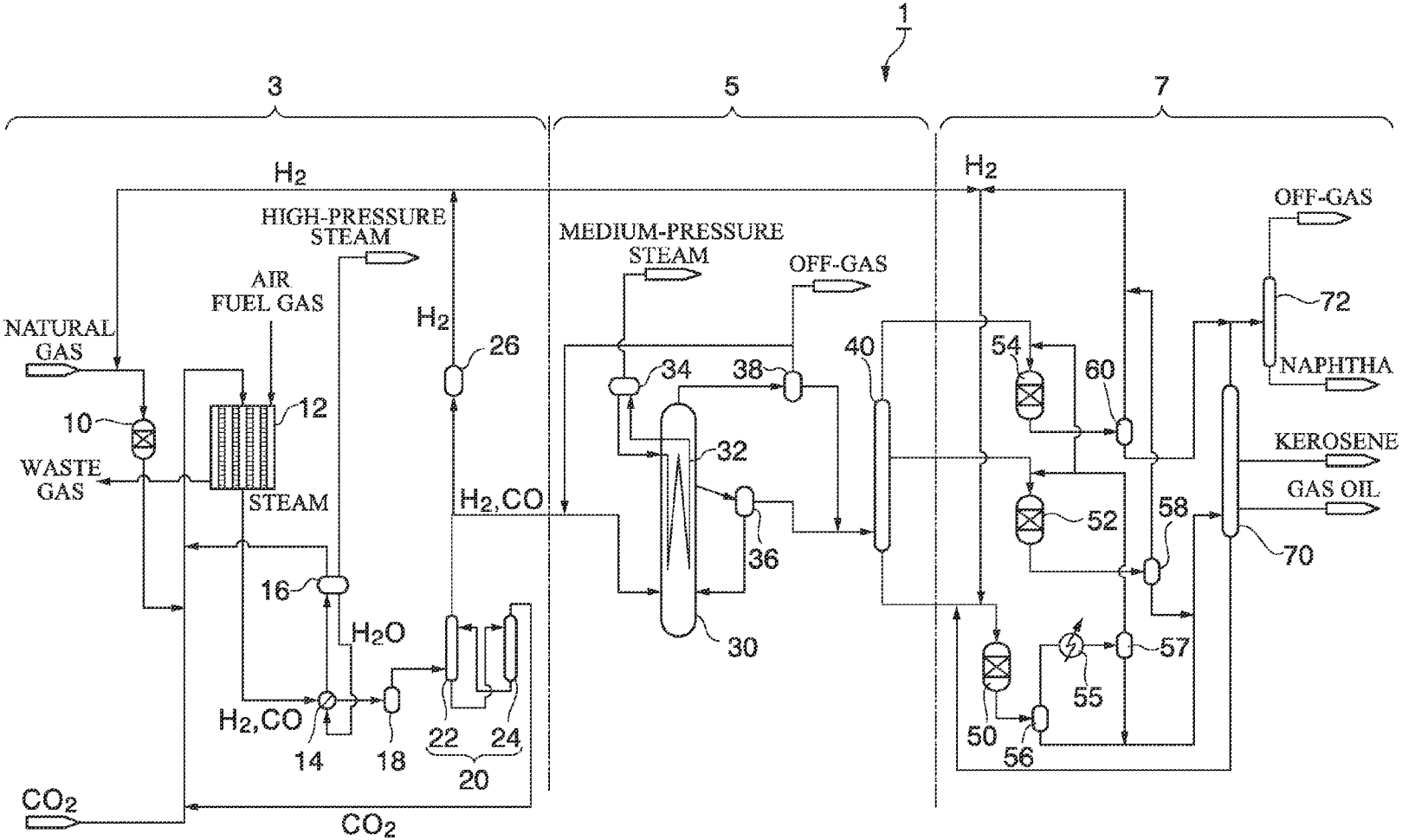
FIG. 1 is a schematic diagram illustrating a liquid fuel synthesizing system.

FIG. 1 illustrates a liquid fuel synthesizing system 1 that carries out a GTL process for converting a hydrocarbon feedstock such as a natural gas to liquid fuels. This liquid fuel synthesizing system 1 is composed of a synthesis gas production unit 3, an FT synthesis unit 5, and an upgrading unit 7.

The synthesis gas production unit 3 reforms a natural gas that functions as a hydrocarbon feedstock to produce a synthesis gas (feedstock gas) including carbon monoxide gas and hydrogen gas.

The FT synthesis unit 5 synthesizes liquid hydrocarbons from the produced synthesis gas via a FT synthesis reaction.

The upgrading unit 7 hydrogenates and fractionates the liquid hydrocarbons synthesized by the FT synthesis reaction to produce base stocks for liquid fuels (such as naphtha, kerosene, gas oil and wax). Components of each of these units are described below.

The synthesis gas production unit 3 is composed mainly of a desulfurization reactor 10, a reformer 12, a waste heat boiler 14, gas-liquid separators 16 and 18, a $CO_2$ removal unit 20, and a hydrogen separator 26.

The desulfurization reactor 10 is composed of a hydrodesulfurizer and the like, and removes sulfur components from the natural gas that functions as the feedstock.

The reformer 12 reforms the natural gas supplied from the desulfurization reactor 10 to produce a synthesis gas containing carbon monoxide gas (CO) and hydrogen gas ($H_2$) as main components.

The waste heat boiler 14 recovers waste heat from the synthesis gas produced in the reformer 12 to generate a high-pressure steam.

The gas-liquid separator 16 separates the water that has been heated by heat exchange with the synthesis gas in the waste heat boiler 14 into a gas (high-pressure steam) and a liquid.

The gas-liquid separator 18 removes a condensed component from the synthesis gas that has been cooled in the waste heat boiler 14, and supplies a gas component to the $CO_2$ removal unit 20.

The $CO_2$ removal unit 20 has an absorption tower 22 that uses an absorbent to remove carbon dioxide gas from the synthesis gas supplied from the gas-liquid separator 18, and a regeneration tower 24 that releases the carbon dioxide gas absorbed by the absorbent, thereby regenerating the absorbent.

The hydrogen separator 26 separates a portion of the hydrogen gas contained within the synthesis gas from which the carbon dioxide gas has already been separated by the $CO_2$ removal unit 20.

The FT synthesis unit 5 includes, for example, a bubble column reactor 30 (a bubble column hydrocarbon synthesis reactor), a gas-liquid separator 34, a separator 36, and a first fractionator 40.

The bubble column reactor 30 is an example of a reactor that synthesizes liquid hydrocarbons from a synthesis gas, and functions as a FT synthesis reactor that synthesizes liquid hydrocarbons from the synthesis gas by the FT synthesis reaction. This bubble column reactor 30 may be composed, for example, from a bubble column slurry bed type reactor in which a slurry prepared by suspending solid catalyst particles within liquid hydrocarbons (the FT synthesis reaction product) is contained in a column type vessel. This bubble column reactor 30 synthesizes liquid hydrocarbons by reacting the carbon monoxide gas and hydrogen gas contained within the synthesis gas produced in the aforementioned synthesis gas production unit 3.

The gas-liquid separator 34 separates the water that has been heated by passage through a heat transfer tube 32 provided inside the bubble column reactor 30 into a steam (medium-pressure steam) and a liquid.

The separator 36 separates the catalyst particles from the liquid hydrocarbons within the catalyst slurry contained in the bubble column reactor 30.

The first fractionator 40 fractionally distills the liquid hydrocarbons, which have been supplied from the bubble column reactor 30 via the separator 36 and the gas-liquid separator 38, into respective fractions.

The upgrading unit 7 includes, for example, a wax fraction hydrocracking reactor 50, a middle distillate hydrotreating reactor 52, a naphtha fraction hydrotreating reactor 54, gas-liquid separators 56, 58 and 60, a second fractionator 70, and a naphtha stabilizer 72.

The wax fraction hydrocracking reactor 50 is connected to the bottom of the first fractionator 40, with the gas-liquid separator 56 provided downstream from the wax fraction hydrocracking reactor 50.

The middle distillate hydrotreating reactor 52 is connected to a middle section of the first fractionator 40, with the gas-liquid separator 58 provided downstream from the middle distillate hydrotreating reactor 52.

The naphtha fraction hydrotreating reactor 54 is connected to the top of the first fractionator 40, with the gas-liquid separator 60 provided downstream from the naphtha fraction hydrotreating reactor 54.

The second fractionator 70 fractionally distills the liquid hydrocarbons supplied from the gas-liquid separators 56 and 58 in accordance with their respective boiling points.

The naphtha stabilizer 72 further fractionally distills the liquid hydrocarbons within the naphtha fraction supplied from the gas-liquid separator 60 and the second fractionator 70, and the resulting light component is discharged as an off-gas, while the heavy component is separated and recovered as a naphtha product.

Next is a description of a process for producing base stocks for liquid fuels from a natural gas (GTL process) using the liquid fuel synthesizing system 1 having the configuration described above.

A natural gas (the main component of which is $CH_4$) is supplied as a hydrocarbon feedstock to the liquid fuel synthesizing system 1 from an external natural gas supply source (not shown in the drawing), such as a natural gas field or a natural gas plant. The above synthesis gas production unit 3 reforms the natural gas to produce a synthesis gas (a mixed gas containing carbon monoxide gas and hydrogen gas as main components).

Specifically, first, the natural gas described above is introduced into the desulfurization reactor 10 together with the hydrogen gas separated by the hydrogen separator 26. In the desulfurization reactor 10, sulfur components contained in the natural gas are converted into a hydrogen sulfide by the introduced hydrogen gas under the conventional action of a hydrodesulfurization catalyst, thus the generated hydrogen sulfide is adsorbed by an absorber such as ZnO. Therefore, the sulfur components are removed from the natural gas.

The desulfurized natural gas is supplied to the reformer 12 after mixing with carbon dioxide gas ($CO_2$) supplied from a carbon dioxide supply source (not shown in the drawing) and the steam generated in the waste heat boiler 14. In the reformer 12, the natural gas is reformed by the carbon dioxide gas and the steam via a steam-carbon dioxide reforming process, thereby producing a high-temperature synthesis gas containing carbon monoxide gas and hydrogen gas as main components.

The high-temperature synthesis gas (for example, 900° C., 2.0 MPaG) produced in the reformer 12 in this manner is supplied to the waste heat boiler 14, and is cooled (for example, to 400° C.) by heat exchange with the water circulating through the waste heat boiler 14, thereby recovering the waste heat from the synthesis gas.

The synthesis gas that has been cooled within the waste heat boiler 14 is supplied to either the absorption tower 22 of the $CO_2$ removal unit 20 or the bubble column reactor 30, after a condensed liquid fraction has been separated and removed from the synthesis gas in the gas-liquid separator 18. In the absorption tower 22, carbon dioxide gas contained in the synthesis gas is absorbed by absorbent, and this carbon dioxide gas is then released from the absorbent in the regeneration tower 24. The released carbon dioxide gas is fed from the regeneration tower 24 into the reformer 12, and is reused for the above reforming reaction.

The synthesis gas produced in the synthesis gas production unit 3 in this manner is supplied to the bubble column reactor 30 of the aforementioned FT synthesis unit 5. At this time, the composition ratio of the synthesis gas supplied to the bubble column reactor 30 is adjusted to a composition ratio suitable for the FT synthesis reaction (for example, $H_2$:CO=2:1 (molar ratio)).

In the hydrogen separator 26, the hydrogen gas contained in the synthesis gas is separated by adsorption and desorption utilizing a pressure difference (hydrogen PSA). The separated hydrogen gas is supplied continuously from a gas holder or the like (not shown in the drawing) via a compressor (not shown in the drawing) to the various hydrogen-utilizing reactors (for example, the desulfurization reactor 10, the wax fraction hydrocracking reactor 50, the middle distillate hydrotreating reactor 52, and the naphtha fraction hydrotreating reactor 54) within the liquid fuel synthesizing system 1 that perform predetermined reactions by utilizing hydrogen gas.

Next, the FT synthesis unit 5 synthesizes liquid hydrocarbons by the FT synthesis reaction from the synthesis gas produced in the above synthesis gas production unit 3.

Specifically, the synthesis gas produced in the synthesis gas production unit 3 is introduced into the bottom of the bubble column reactor 30, and rises up through the catalyst slurry contained within the bubble column reactor 30. During this time within the bubble column reactor 30, the carbon monoxide gas and hydrogen gas contained within the synthesis gas react with each other by the aforementioned FT synthesis reaction, and hydrocarbons are produced.

The liquid hydrocarbons synthesized in the bubble column reactor 30 are introduced into the separator 36 as the catalyst slurry that also includes catalyst particles.

In the separator 36, the introduced catalyst slurry is separated into a solid component composed of the catalyst particles and the like and a liquid component containing the liquid hydrocarbons. A portion of the separated solid component composed of the catalyst particles and the like is returned to the bubble column reactor 30, and the liquid component is supplied to the first fractionator 40.

Gaseous product, which is gaseous under the conditions in the bubble column reactor 30 containing unreacted synthesis gas and gaseous hydrocarbons generated in the synthesis reaction, is discharged from the top of the bubble column reactor 30 and supplied to the gas-liquid separator 38. In the gas-liquid separator 38, this gaseous product is cooled, and condensed liquid hydrocarbons are separated and introduced into the first fractionator 40. The gas component separated by the gas-liquid separator 38 contains the unreacted synthesis gas (CO and $H_2$) and hydrocarbons with a carbon number of 4 or less as main components, and a portion of this gas component is reintroduced into the bottom of the bubble column reactor 30 and the unreacted synthesis gas therein is reused for the FT synthesis reaction. Further, the gas component that is not reused in the FT synthesis reaction is discharged as an off-gas, which may be used as a fuel gas, treated for the recovery of fuels equivalent to LPG (Liquefied Petroleum Gas), or reused as a feedstock for the reformer 12 of the synthesis gas production unit.

Subsequently, in the first fractionator 40, the liquid hydrocarbons supplied from the bubble column reactor 30 via the separator 36 and the gas-liquid separator 38 in the manner described above are fractionally distilled into a naphtha fraction (with a boiling point that is lower than approximately 150° C.), a middle distillate equivalent to a kerosene and gas oil fraction (with a boiling point of approximately 150 to 360° C.), and a wax fraction (with a boiling point that exceeds approximately 360° C.).

Subsequently, the upgrading unit 7 mentioned above hydroprocesses the liquid hydrocarbons produced in the FT synthesis unit 5 to produce base stocks for liquid fuels (such as naphtha, kerosene, gas oil and wax).

The liquid hydrocarbons of the wax fraction (mainly hydrocarbons of $C_{21}$ or more) discharged from the bottom of the first fractionator 40 are brought into the wax fraction hydrocracking reactor 50. The liquid hydrocarbons of the middle distillate (mainly hydrocarbons of $C_{11}$ to $C_{20}$) discharged from the middle section of the first fractionator 40 are brought into the middle distillate hydrotreating reactor 52. The liquid hydrocarbons of the naphtha fraction (mainly hydrocarbons of $C_5$ to $C_{10}$) discharged from the top of the first fractionator 40 are brought into the naphtha fraction hydrotreating reactor 54.

The wax fraction hydrocracking reactor 50 hydrocracks the liquid hydrocarbons of the wax fraction (hydrocarbons of approximately $C_{21}$ or more) discharged from the bottom of the first fractionator 40, by using the hydrogen gas supplied from the above hydrogen separator 26 to reduce the carbon number to approximately 20 or less. In this hydrocracking reaction, C—C bonds of hydrocarbons with a large carbon number are cleaved by the action of catalysts and heat, thereby producing hydrocarbons with a smaller carbon number. The products including the liquid hydrocarbons produced by hydrocracking within the wax fraction hydrocracking reactor 50 are separated into gases and liquids in a stepwise manner by the multiple stages of gas-liquid separators 56 and 57. The separated liquid hydrocarbons are brought into the second fractionator 70, whereas the separated gas component (including hydrogen gas) is brought into the middle distillate hydrotreating reactor 52 and the naphtha fraction hydrotreating reactor 54.

In the middle distillate hydrotreating reactor 52, the liquid hydrocarbons of the middle distillate having a mid-range carbon number (of approximately $C_{11}$ to $C_{20}$) that have been discharged from the middle section of the first fractionator 40 are hydrotreated using hydrogen gas supplied from the hydrogen separator 26 via the wax fraction hydrocracking reactor 50. During this hydrotreating, the olefins produced as by-products in the FT synthesis reaction are hydrogenated, oxygen-containing compounds such as alcohols are hydrodeoxygenated and converted into paraffins, and normal paraffins are hydroisomerized to form isoparaffins.

The product containing the hydrotreated liquid hydrocarbons is separated into a gas and a liquid in the gas-liquid separator 58. The separated liquid hydrocarbons are brought into the second fractionator 70, and the separated gas fraction (containing hydrogen gas) is reused for the above hydrogenation reactions.

In the naphtha fraction hydrotreating reactor 54, the liquid hydrocarbons of the naphtha fraction having a low carbon number (of approximately $C_{10}$ or less) that have been discharged from the top of the first fractionator 40 are hydrotreated using hydrogen gas supplied from the hydrogen separator 26 via the wax fraction hydrocracking reactor 50. The product containing the hydrotreated liquid hydrocarbons is separated into a gas and a liquid in the gas-liquid separator 60. The separated liquid hydrocarbon compounds are brought into the naphtha stabilizer 72, and the separated gas fraction (containing hydrogen gas) is reused for the above hydrogenation reactions.

Subsequently, in the second fractionator 70, the liquid hydrocarbons supplied from the wax fraction hydrocracking reactor 50 and the middle distillate hydrotreating reactor 52 in the manner described above are fractionally distilled into hydrocarbons of $C_{10}$ or less (with boiling points lower than approximately 150° C.), a kerosene fraction (with a boiling point of approximately 150 to 250° C.), a gas oil fraction (with a boiling point of approximately 250 to 360° C.) and an uncracked wax fraction (with a boiling point exceeding approximately 360° C.) which has not been sufficiently hydrocracked in the wax fraction hydrocracking reactor 50. The uncracked wax fraction is obtained from the bottom of the second fractionator 70, and is recycled to a position upstream of the wax fraction hydrocracking reactor 50. The kerosene fraction and gas oil fraction are discharged from the middle section of the second fractionator 70. Meanwhile, hydrocarbons of $C_{10}$ or less are discharged from the top of the second fractionator 70 and supplied to the naphtha stabilizer 72.

Moreover, in the naphtha stabilizer 72, the hydrocarbons of $C_{10}$ or less supplied from the naphtha fraction hydrotreating reactor 54 and the second fractionator 70 are fractionally distilled, and naphtha ($C_5$ to $C_{10}$) is obtained as a product. Accordingly, high-purity naphtha is discharged from the bottom of the naphtha stabilizer 72. Meanwhile, an off-gas containing hydrocarbons with a carbon number no higher than 4 as main components, namely compounds other than the targeted product, is discharged from the top of the naphtha stabilizer 72. This off-gas may be used as a fuel gas, or treated for the recovery of fuels equivalent to LPG.

Figure 2:
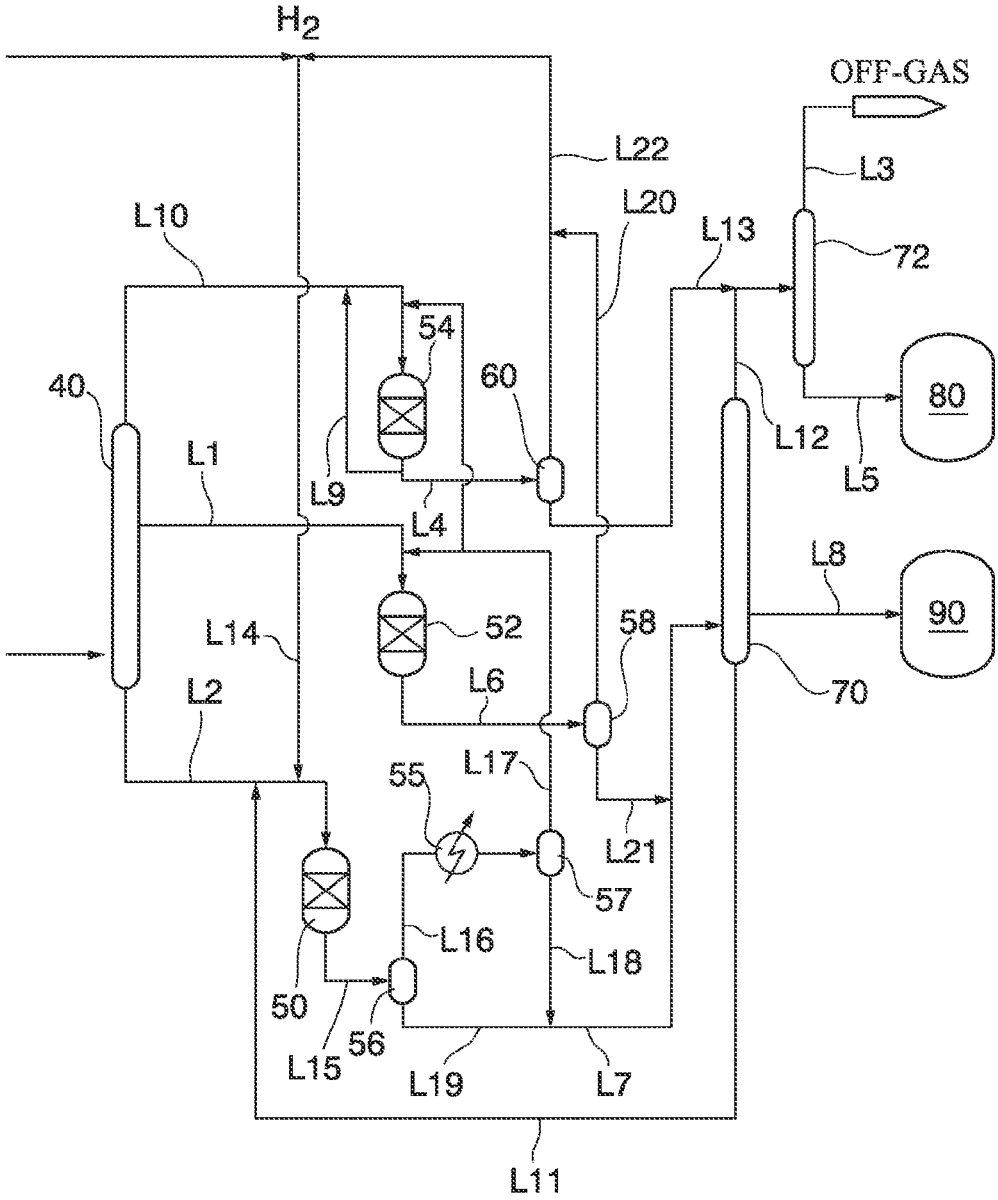
FIG. 2 is a diagram illustrating a specific example of an upgrading unit.

FIG. 2 is a diagram illustrating the upgrading unit 7.

There are no particular limitations on the liquid hydrocarbons that are to be used as a feedstock for the production of liquid fuel base stocks within the upgrading unit 7, provided the liquid hydrocarbons are synthesized by the FT synthesis reaction. However, in terms of maximizing the yield of the middle distillate, the liquid hydrocarbons preferably contains at least 80 mass % of hydrocarbons with a boiling point of approximately 150° C. or higher based on the total mass of the liquid hydrocarbons obtained by the FT synthesis reaction.

The liquid hydrocarbons produced by the conventional FT synthesis reaction is typically a mixture containing mainly aliphatic hydrocarbons having a very broad carbon number distribution, but a fraction obtained by subjecting this liquid hydrocarbons to a preliminary fractional distillation may also be used.

The naphtha fraction is the component that distills at a temperature lower than approximately 150° C. within the first fractionator 40, the middle distillate is the component that distills at a temperature of not lower than approximately 150° C. and not higher than approximately 360° C., and the wax fraction is the component that does not distill at a temperature of approximately 360° C. within the first fractionator 40, but is rather discharged from the bottom of the fractionator.

This description describes a preferred embodiment in which two cut points (namely, at approximately 150° C. and approximately 360° C.) are set in the first fractionator 40, thereby separating the liquid hydrocarbons into three fractions, but for example, a single cut point may also be set, in which case the fraction that distills at a temperature below the cut point is discharged as the middle distillate and supplied to the middle distillate hydrotreating reactor 52 via a line L1, and the fraction with a boiling point exceeding the cut point is discharged as the wax fraction via a line L2.

In the naphtha fraction hydrotreating reactor 54, the naphtha fraction is hydrotreated by a conventional process, thereby converting the olefins contained within the naphtha fraction into paraffinic hydrocarbons, and converting oxygen-containing compounds such as alcohols into paraffinic hydrocarbons and water.

In the middle distillate hydrotreating reactor 52, a conventional process is used to convert olefins and oxygen-containing compounds within the middle distillate into paraffinic hydrocarbons, in a similar manner to that described above for the naphtha fraction hydrotreating reactor 54. Further, at the same time, in order to improve the low-temperature properties (low-temperature fluidity) of the product oil for use as a fuel oil base stock, at least a portion of the normal paraffins contained within the middle distillate are hydroisomerized and converted to isoparaffins.

In the wax fraction hydrocracking reactor 50, a conventional process using a hydrocracking catalyst is used to hydrocrack the wax fraction and produce compounds equivalent to the middle distillate. During this process, the olefins and oxygen-containing compounds such as alcohols contained within the wax fraction are converted to paraffins. Furthermore, at the same time, hydroisomerization of normal paraffins also proceeds, which contributes to an improvement in the low-temperature properties (low-temperature fluidity) of the product oil for use as a fuel oil base stock.

On the other hand, a portion of the wax fraction undergoes excessive hydrocracking, and is converted to hydrocarbons equivalent to the low-boiling point naphtha fraction having an even lower boiling point than the boiling point range of the targeted middle distillate. Furthermore, a portion of the wax fraction undergoes even more hydrocracking, and is converted to gaseous hydrocarbons with a carbon number of 4 or less, such as butanes, propane, ethane and methane.

In the upgrading unit 7 illustrated in FIG. 2, the gas-liquid separator 60, the naphtha stabilizer 72 and a naphtha tank 80 are provided downstream from the naphtha fraction hydrotreating reactor 54. In the naphtha stabilizer 72, the gaseous hydrocarbons composed mainly of hydrocarbons having a carbon number of 4 or less that are contained within the naphtha fraction that has passed through the naphtha fraction hydrotreating reactor 54 are discharged from a line L3 connected to the top of the naphtha stabilizer 72. The naphtha fraction that has passed through the naphtha fraction hydrotreating reactor 54 is supplied to the gas-liquid separator 60 through a line L4. Following separation of the hydrogen gas within the gas-liquid separator 60, the naphtha fraction is supplied to the naphtha stabilizer 72 through a line L13. The hydrogen gas separated from the naphtha fraction in the gas-liquid separator 60 is supplied to the wax fraction hydrocracking reactor 50 via lines L22 and L14. Following removal of the gaseous hydrocarbons in the naphtha stabilizer 72, the naphtha fraction passes through a line L5 and into the naphtha tank 80 for storage.

Furthermore, the second fractionator 70 is positioned downstream from the middle distillate hydrotreating reactor 52 and the wax fraction hydrocracking reactor 50, and this second fractionator 70 is supplied with the outflow oil from the middle distillate hydrotreating reactor 52 and the hydrocracked product from the wax fraction hydrocracking reactor 50, and fractionally distills the resulting mixture. Moreover, a middle distillate tank 90 is provided that stores the middle distillate that has been fractionally distilled in the second fractionator 70. The outflow oil from the middle distillate hydrotreating reactor 52 is supplied to the gas-liquid separator 58 through a line L6. The middle distillate from which hydrogen gas has been separated by the gas-liquid separator 58 is supplied to the second fractionator 70 through a line L21. The outflow oil (hydrocracked product) from the wax fraction hydrocracking reactor 50 is supplied to the second fractionator 70 through a line L19 and a line L7. The hydrogen gas separated from the middle distillate in the gas-liquid separator 58 is supplied to the wax fraction hydrocracking reactor 50 through lines L20, L22 and L14. The outflow oil from the middle distillate hydrotreating reactor 52 and the outflow oil (hydrocracked product) from the wax fraction hydrocracking reactor 50 that are supplied to the second fractionator 70 may be mixed by either in-line blending or tank blending, and there are no particular limitations on the mixing method employed.

In this example, the middle distillate is obtained as a single fraction from the second fractionator 70, and this middle distillate passes through a line L8 and is stored in the middle distillate tank 90. However, the middle distillate may be fractionally distilled into an appropriate plurality of fractions, for example, a kerosene fraction and a gas oil fraction, and these two fractions then fed into separate tanks for storage.

Furthermore, in the upgrading unit 7, a portion of the hydrotreated naphtha fraction from the naphtha fraction hydrotreating reactor 54 is passed through a line L9 and recycled to a line L10 upstream from the naphtha fraction hydrotreating reactor 54. The hydrotreating of the naphtha fraction is a highly exothermic reaction, and if only the untreated naphtha fraction is subjected to the hydrotreating, then there is possibility that the temperature of the naphtha fraction in the naphtha fraction hydrotreating reactor 54 may increase excessively. Accordingly, by recycling a portion of the hydrotreated naphtha fraction, the untreated naphtha fraction is diluted, thereby preventing any excessive temperature increase.

The bottom oil from the second fractionator 70 is composed mainly of the uncracked wax fraction, namely the wax fraction that has not undergone sufficient hydrocracking during the wax fraction hydrocracking step. This bottom oil is recycled through a line L11 to a line L2 that is upstream from the wax fraction hydrocracking reactor 50, and is once again supplied to the wax fraction hydrocracking reactor 50 and subjected to hydrocracking. This process improves the middle distillate yield.

On the other hand, the light fraction discharged from the top of the second fractionator 70 passes through a line L12 to the line L13, and is then supplied to the naphtha stabilizer 72.

The periphery around the wax fraction hydrocracking reactor 50 is illustrated in detail in FIG. 2, and a hydrocracking process for the wax fraction is described below with reference to FIG. 2.

In this example, the wax fraction hydrocracking reactor 50 includes a fixed-bed flow reactor, and this reactor is filled with a type of hydrocracking catalyst described below in detail. The FT wax fraction is supplied via the line L2, while hydrogen gas is supplied via the line L14 that connects to the line L2, and these two components are mixed together and then supplied to the wax fraction hydrocracking reactor 50, where the wax fraction undergoes hydrocracking.

Further, a multi-stage gas-liquid separator that is described below in detail is provided downstream from the wax fraction hydrocracking reactor 50.

Detailed descriptions of each of the steps in the hydrocracking process for the wax fraction are presented below.

(Wax Fraction Hydrocracking Step)

As illustrated in FIG. 2, in the wax fraction hydrocracking step, the FT wax fraction introduced through the line L2 is subjected to hydrocracking in the wax fraction hydrocracking reactor 50, thus producing a hydrocracked product.

Examples of the hydrocracking catalyst used in the wax fraction hydrocracking step include catalysts comprising a metal belonging to groups 8-10 of the periodic table as an active metal loaded on a support containing a solid acid. "Periodic table" refers to the long period type periodic table of elements prescribed by IUPAC (the International Union of Pure and Applied Chemistry).

Specific examples of the support include supports containing one or more solid acids selected from among crystalline zeolites such as ultra-stable Y-type (USY) zeolite, Y-type zeolite and β-zeolite, and refractory amorphous composite metal oxides such as silica-alumina, silica-zirconia and alumina-boria. The support preferably contains one or more solid acids selected from among USY zeolite, silica-alumina, alumina-boria and silica-zirconia, and most preferably contains USY zeolite together with alumina-boria and/or silica-alumina.

USY zeolite is prepared by ultra stabilizing a Y-type zeolite via a hydrothermal treatment and/or an acid treatment, and in addition to the micropore structure with a pore size of 2 nm or less inherent to Y-zeolite, USY zeolite also includes new pores having a pore size within a range from 2 to 10 nm. The average particle size of the USY zeolite is not particularly limited, but is preferably not more than 1.0 μm, and more preferably 0.5 μm or less. Further, in the USY zeolite, the silica/alumina molar ratio (the molar ratio of silica relative to alumina) is preferably within a range from 10 to 200, more preferably from 15 to 100, and still more preferably from 20 to 60.

Furthermore, the support preferably includes 0.1 to 80 mass % of the crystalline zeolite and 0.1 to 60 mass % of the refractory amorphous composite metal oxide.

The support can be produced by molding a support composition containing the solid acid described above and a binder, and then calcining the composition. The blend proportion of the solid acid relative to the total mass of the support is preferably within a range from 1 to 70 mass %, and more preferably from 2 to 60 mass %. Furthermore, in those cases where the support includes USY zeolite, the blend proportion of the USY zeolite relative to the total mass of the support is preferably within a range from 0.1 to 10 mass %, and more preferably from 0.5 to 5 mass %. Moreover, in those cases where the support includes USY zeolite and alumina-boria, the blend ratio between the USY zeolite and the alumina-boria (USY zeolite/alumina-boria) is preferably a mass ratio within a range from 0.03 to 1. Further, in those cases where the support includes USY zeolite and silica-alumina, the blend ratio between the USY zeolite and the silica-alumina (USY zeolite/silica-alumina) is preferably a mass ratio within a range from 0.03 to 1.

There are no particular limitations on the binder, although alumina, silica, titania or magnesia is preferred, and alumina is particularly desirable. The blend amount of the binder relative to the total mass of the support is preferably within a range from 20 to 98 mass %, and more preferably from 30 to 96 mass %.

The calcination temperature for the support composition described above is preferably within a range from 400 to 550° C., more preferably from 470 to 530° C., and still more preferably from 490 to 530° C.

Specific examples of the metal belonging to groups 8-10 of the periodic table include cobalt, nickel, rhodium, palladium, iridium and platinum. Of these, the use of either one metal or a combination of two or more metals selected from among nickel, palladium and platinum is preferred. These metals can be loaded on the aforementioned support using typical methods such as impregnation or ion exchange. Although there are no particular limitations on the amount of metal supported on the support, the total mass of the metal relative to the mass of the support is preferably within a range from 0.1 to 3.0 mass %.

The hydrogen partial pressure in the wax fraction hydrocracking step is typically within a range from 0.5 to 12 MPa, and is preferably from 1.0 to 5.0 MPa.

The liquid hourly space velocity (LHSV) is typically within a range from 0.1 to 10.0 $h^{-1}$, and is preferably from 0.3 to 3.5 $h^{-1}$. The ratio between the hydrogen gas and the wax fraction (hydrogen gas/oil ratio) is not particularly limited, but is typically within a range from 50 to 1,000 NL/L, and is preferably from 70 to 800 NL/L.

In this description, the LHSV (liquid hourly space velocity) describes the volumetric flow rate of the wax fraction under standard conditions (25° C., 101,325 Pa) per unit volume of the layer of the catalyst (the catalyst layer) charged into the fixed-bed flow reactor, wherein the units "$h^{-1}$" represent the inverse of "hour". Further, the units "NL" for the hydrogen volume within the hydrogen gas/oil ratio represent the hydrogen gas volume (L) under standard conditions (0° C., 101,325 Pa).

The reaction temperature for the wax fraction hydrocracking step (namely, the catalyst weighted average bed temperature) is typically within a range from 180 to 400° C., and is preferably from 200 to 370° C., more preferably from 250 to 350° C., and still more preferably from 280 to 350° C. If the reaction temperature exceeds 400° C., then the hydrocracking tends to proceed excessively, resulting in a reduction in the yield of the targeted middle distillate. Further, the hydrocracked product may become discolored, placing limits on its potential use as a base stock for fuels. In contrast, if the reaction temperature is lower than 180° C., then the hydrocracking of the wax fraction does not progress sufficiently, and the yield of the middle distillate tends to decrease. Further, the removal of oxygen-containing compounds such as alcohols contained within the wax fraction tends to be inadequate.

The reaction temperature is controlled by adjusting the temperature setting at the outlet of the heat exchanger (not shown in the drawings) provided within the line L2.

In this type of wax fraction hydrocracking step, the wax fraction hydrocracking reactor 50 is preferably operated so that the content of a specific hydrocarbon component within the hydrocracked product, namely those hydrocarbon components having a boiling point of not less than 25° C. and not more than 360° C., based on the total mass of the hydrocracked product having a boiling point of 25° C. or higher, is preferably within a range from 20 to 90 mass %, more preferably from 30 to 80 mass % and still more preferably from 45 to 70 mass %. Provided the content of this specific hydrocarbon component satisfies the range mentioned above, the degree of progression of the hydrocracking is at an appropriate level, meaning the yield of the middle distillate can be increased.

(Gas-Liquid Separation Step)

The hydrocracked product from the wax fraction hydrocracking step is introduced into a multi-stage gas-liquid separator composed of a first gas-liquid separator 56 and a second gas-liquid separator 57. A heat exchanger (not shown in the drawings) for cooling the hydrocracked product is preferably installed within a line L15 connected to the outlet of the wax fraction hydrocracking reactor 50. Following cooling by this heat exchanger, the hydrocracked product is separated into a gas component and a liquid component by the first gas-liquid separator 56. The temperature inside the first gas-liquid separator 56 is preferably approximately 210 to 260° C. In other words, the liquid component separated within the first gas-liquid separator 56 is a heavy oil component composed of hydrocarbons that exist in a liquid state at the above temperature, and includes a large amount of the uncracked wax fraction. This heavy oil component passes out the bottom of the first gas-liquid separator 56, through the line L19 and the line L7, and is supplied to the second fractionator 70.

The volumetric flow rate per hour (L/H) of this heavy oil component discharged from the first gas-liquid separator 56 is termed $F_H$.

Meanwhile, the gas component separated within the first gas-liquid separator 56 passes from the top of the first gas-liquid separator 56, through a line L16, to a heat exchanger (cooling device) 55, where it is cooled and at least partially liquefied. The outflow from the heat exchanger 55 is supplied to the second gas-liquid separator 57. As a result of the cooling by the heat exchanger 55, the temperature at the inlet to the second gas-liquid separator 57 is approximately 90 to 100° C.

In the second gas-liquid separator 57, the gas component and the liquid component condensed (liquefied) by the cooling in the heat exchanger 55 are separated. The separated gas component is discharged from the top of the second gas-liquid separator 57 through a line L17. A heat exchanger (not shown in the drawings) is preferably provided within the line L17 to cool the gas component to approximately 40° C. This liquefies a portion of the light hydrocarbons within the gas component, which is then returned to the second gas-liquid separator 57. The remaining gas component is composed mainly of hydrogen gas containing gaseous hydrocarbons, and this gas component is supplied to the middle distillate hydrotreating reactor 52 or the naphtha fraction hydrotreating reactor 54, and reused as hydrogen gas for the hydrogenation reactions.

Meanwhile, the liquid component is discharged from a line L18 connected to the bottom of the second gas-liquid separator 57. This liquid component is a light oil component composed of lighter hydrocarbons that condense within the second gas-liquid separator 57 at a lower temperature than that within the first gas-liquid separator 56. This light oil component is supplied through the line L7, together with the heavy oil component from the first gas-liquid separator 56, to the second fractionator 70.

The volumetric flow rate per hour (L/H) of this light oil component obtained from the second gas-liquid separator 57 is termed $F_L$.

By providing the multi-stage gas-liquid separator in this manner, and employing the method wherein cooling is performed in a stepwise manner, it is possible to prevent problems in that the components having a high freezing point (particularly the uncracked wax fraction) within the hydrocracked product from the wax fraction hydrocracking step are solidified by rapid cooling to cause clogging of the apparatus or the like.

(Specific Component Content Estimation Step)

Subsequently, in the specific component content estimation step determining an estimated value for the content of the specific hydrocarbon component, first, a production ratio is determined between the heavy oil component obtained in the first gas-liquid separator 56 and the light oil component obtained in the second gas-liquid separator 57. This production ratio is calculated as the ratio between the respective flow rates per unit of time for the heavy oil component and the light oil component discharged from the first gas-liquid separator 56 and the second gas-liquid separator 57 respectively. These flow rates may be either volumetric flow rates or mass flow rates. In this description, volumetric flow rates are used.

In this example, the volumetric flow rate per hour of the heavy oil component discharged from the first gas-liquid separator 56 is termed $F_H$ (L/H), and the volumetric flow rate per hour of the light oil component obtained from the second gas-liquid separator 57 is termed $F_L$ (L/H), The volumetric flow rate ratio (%) of the light oil component relative to the combined flow rates is determined using the formula (1) below, and the resulting value is recorded as the "light oil component flow rate ratio" (hereafter also abbreviated as simply the "flow rate ratio").

$$\text{Light oil component flow rate ratio (\%)} = F_L \times 100/(F_H + F_L) \quad (1)$$

Figure 3:
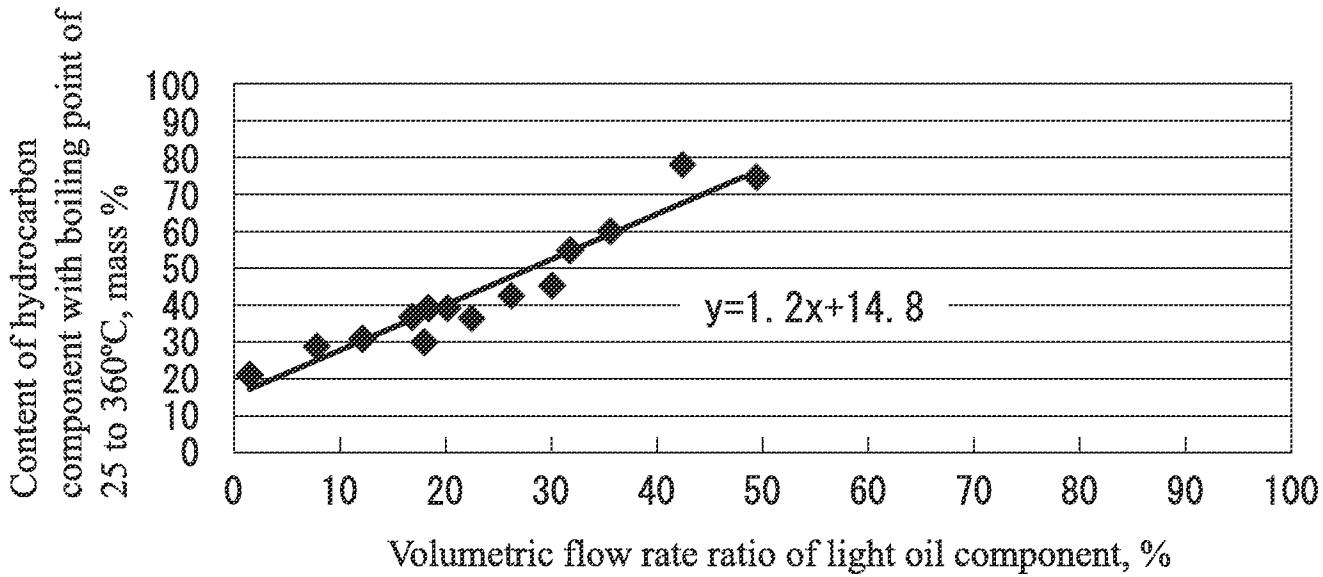
FIG. 3 is a graph illustrating the relationship between the flow rate ratio between a heavy oil component and a light oil component, and the content of a specific hydrocarbon component within a hydrocracked product.

As a result of repeated investigation by the inventors of the present invention it was discovered that the above flow rate ratio and the content of a specific hydrocarbon component contained within the hydrocracked product from the wax fraction hydrocracking step, namely the content of the hydrocarbon component having a boiling point of not lower than 25° C. and not higher than 360° C., exhibited a linear correlation illustrated in FIG. 3.

As illustrated in FIG. 3, a plurality of experimental data are collected for (x,y)=(light oil component flow rate ratio, content of hydrocarbon component having a boiling point of not lower than 25° C. and not higher than 360° C.), and these data are then plotted. Then, a linear approximation (such as linear fitting using a least squares method) is used to determine a relational formula that expresses the relationship between the flow rate ratio (x) and the specific hydrocarbon component content (y). In the example shown in FIG. 3, the relational formula: y=1.2x+14.8 is obtained.

Accordingly, during operation of the wax fraction hydrocracking reactor 50, by simply obtaining the values for $F_H$ (L/H) and $F_L$ (L/H), for example using flow meters (not shown in the drawings) installed within the line L19 and the line L18 respectively, calculating a flow rate ratio from these values, and then inserting this flow rate ratio into the relational formula, a value (estimated value) can be determined for the content of the specific hydrocarbon component within the hydrocracked product from the wax fraction hydrocracking step, which is represented on the vertical axis of the graph shown in FIG. 3. By employing this type of method, simply determining this flow rate ratio enables the content of the specific hydrocarbon component, namely the degree of progression of the hydrocracking reaction, to be ascertained almost immediately.

In the above example, the specific hydrocarbon component was deemed to be the hydrocarbon component having a boiling point of not lower than 25° C. and not higher than 360° C., but the specific hydrocarbon component is not limited to this particular component. In other words, in this example the upper limit for the boiling point of the hydrocarbons that constitute the targeted middle distillate is set to 360° C., and therefore the upper limit for the boiling point range for the specific hydrocarbon component is preferably also set to 360° C. In those cases where the upper limit for the boiling point of the hydrocarbons that constitute the targeted middle distillate is set to a temperature other than 360° C., this alternative upper limit temperature is preferably also set as the upper limit for the boiling point range for the specific hydrocarbon component.

(Control Step)

Subsequently, based on the value (estimated value) for the content of the aforementioned specific hydrocarbon component estimated in the specific component content estimation step, the wax fraction hydrocracking step is controlled by adjusting the hydrocracking reaction conditions so that the content of the specific hydrocarbon component falls within a predetermined range (target range). Specifically, if, as described above, the content of the specific hydrocarbon component falls within a range from 20 to 90 mass %, and preferably 30 to 80 mass %, and more preferably 45 to 70 mass %, then the wax fraction hydrocracking step is adjudged to be under favorable control, with the progression of the hydrocracking reaction maintained at an appropriate level. In contrast, if the content of the specific hydrocarbon component is either less than the lower limit of this range or greater than the upper limit of this range, then the progression of the wax fraction hydrocracking is adjudged to be unsatisfactory. In such a case, the wax fraction hydrocracking step can be controlled by appropriately altering the reaction conditions for the wax fraction hydrocracking step such as the reaction temperature (catalyst weighted average bed temperature), the hydrogen partial pressure, the liquid hourly space velocity (LHSV) and/or the hydrogen gas/oil ratio so that the content of the specific hydrocarbon component satisfies the above predetermined range. For example, in those cases where operational control is achieved by altering the reaction temperature, an operation to increase the reaction temperature is performed if the (estimated) content of the specific hydrocarbon component is less than the lower limit of the above range, whereas an operation to decrease the reaction temperature is performed if the (estimated) content of the specific hydrocarbon component exceeds the upper limit of the above range.

According to this type of method, by determining the relational formula between the flow rate ratio (x) and the specific hydrocarbon component content (y) in advance, and then using this relational formula, the content of the specific hydrocarbon component within the hydrocracked product from the wax fraction hydrocracking step can be estimated easily and rapidly, and based on this estimation, the degree of progression of the wax fraction hydrocracking can be appropriately controlled, almost in real time.

In this example, the flow rate ratio between the heavy oil component and the light oil component employed the "ratio (%) of the flow rate of the light oil component relative to the combined flow rates of the heavy oil component and the light oil component" represented by the above formula (1), and the relational formula between this ratio and the content of the specific hydrocarbon component was determined in advance. However, the flow rate ratio between the heavy oil component and the light oil component may also employ the heavy oil component flow rate ratio (%) represented by formula (2) shown below, or either of the ratios represented by formulas (3) and (4) shown below. Furthermore, as mentioned above, each of the flow rates may also be expressed as mass flow rates.

$$\text{Heavy oil component volumetric flow rate ratio } (\%) = F_H \times 100/(F_H + F_L) \quad (2)$$

$$\text{Ratio of light oil component relative to heavy oil component} = F_L/F_H \quad (3)$$

$$\text{Ratio of heavy oil component relative to light oil component} = F_H/F_L \quad (4)$$

Further, in this example, as the multi-stage gas-liquid separator, a two-stage separator composed of the first gas-liquid separator 56 and the second gas-liquid separator 57 is described, but any multiplicity of stages may be employed, and for example, a third gas-liquid separator may be provided downstream from the above two gas-liquid separators. In such a case, only the liquid component obtained from the most upstream gas-liquid separator (the first gas-liquid separator 56) is specified as the heavy oil component, and the liquid components obtained from all of the subsequent gas-liquid separators (namely, from the second gas-liquid separator 57 onward) may all be specified as light oil components, with the flow rate ratio of these light oil components then being determined accordingly.

While preferred embodiments of the present invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

In the above embodiments, a liquid fuel synthesizing system 1 used within a plant for converting a hydrocarbon feed stock such as a natural gas to liquid fuels was described, but the present invention is not only for application to the case using a natural gas as a feedstock, and can also be applied to the case using hydrocarbons other than natural gas, such as asphalt and residual oils, as a feedstock. In other words, the present invention can be applied to any system that synthesizes hydrocarbons by contacting a catalyst slurry and a feedstock gas containing at least carbon monoxide gas and hydrogen gas, and from the obtained hydrocarbons, produces hydrocarbon oils to be used for liquid fuel base stocks or the like.

In the process for producing a hydrocarbon oil of the invention, "a hydrocarbon oil" refers to a hydrocarbon oil of a hydrocracked product of wax fraction produced by the hydrocracking process of the invention, naphtha fraction and middle distillate obtained by fractional distillation thereof, and kerosene fraction and gas oil fraction obtained by fractional distillation of the middle distillate, or mixture thereof.

INDUSTRIAL APPLICABILITY

The present invention relates to a hydrocracking process that includes a wax fraction hydrocracking step of hydrocracking the wax fraction contained within a liquid hydrocarbon produced by a FT synthesis reaction, thereby obtaining a hydrocracked product, a gas-liquid separation step of using a multi-stage gas-liquid separator to separate the hydrocracked product into a gas component, a heavy oil component and a light oil component, a specific component content estimation step of determining the flow rate ratio between the heavy oil component and the light oil component, and using this flow rate ratio to determine an estimated value for the content of a specific hydrocarbon component contained within the hydrocracked product, and a control step of controlling the operation of the wax fraction hydrocracking step on the basis of this estimated value, so that the content of the specific hydrocarbon component falls within a predetermined range, and relates to a process for producing a hydrocarbon oil utilizing the hydrocracking process.

According to the present invention, a middle distillate can be obtained stably and with high yield from the liquid hydrocarbons obtained from the FT synthesis reaction.

DESCRIPTION OF THE REFERENCE SIGNS

50: Wax fraction hydrocracking reactor
55: Heat exchanger (cooling device)
56: First gas-liquid separator
57: Second gas-liquid separator

The invention claimed is:

1. A hydrocracking process, comprising:

a wax fraction hydrocracking step of hydrocracking a wax fraction contained within a liquid hydrocarbon synthesized by a Fischer-Tropsch synthesis reaction, thereby obtaining a hydrocracked product;

a gas-liquid separation step of using a multi-stage gas-liquid separator to separate said hydrocracked product into a gas component, a heavy oil component and a light oil component;

a specific component content estimation step of determining a flow rate ratio between said heavy oil component and said light oil component, and using said flow rate ratio to determine an estimated value for a content of a specific hydrocarbon component contained within said hydrocracked product; and a control step of controlling an operation of said wax fraction hydrocracking step based on said estimated value, so that a content of said specific hydrocarbon component falls within a predetermined range.

2. The hydrocracking process according to claim 1, wherein said specific hydrocarbon component is a hydrocarbon component having a boiling point within a range from 25 to 360° C.

3. The hydrocracking process according to claim 1 or claim 2, wherein said multi-stage gas-liquid separator comprises a first gas-liquid separator, a cooling device that cools a gas component separated by said first gas-liquid separator and liquefies at least a portion of said gas component, and a second gas-liquid separator that performs a gas-liquid separation of an outflow from said cooling device, wherein said heavy oil component is a liquid component obtained from said first gas-liquid separator, and said light oil component is a liquid component obtained from said second gas-liquid separator.

4. A process for producing a hydrocarbon oil, comprising:

a liquid hydrocarbon production step of producing a liquid hydrocarbon from a feedstock gas comprising carbon monoxide gas and hydrogen gas by a Fischer-Tropsch synthesis reaction;

a wax fraction hydrocracking step of hydrocracking a wax fraction contained within said liquid hydrocarbon produced in said liquid hydrocarbon production step, thereby obtaining a hydrocracked product;

a gas-liquid separation step of using a multi-stage gas-liquid separator to separate said hydrocracked product into a gas component, a heavy oil component and a light oil component;

a specific component content estimation step of determining a flow rate ratio between said heavy oil component and said light oil component, and using said flow rate ratio to determine an estimated value for a content of a specific hydrocarbon component contained within said hydrocracked product; and a control step of controlling an operation of said wax fraction hydrocracking step based on said estimated value, so that a content of said specific hydrocarbon component falls within a predetermined range.

5. The process for producing a hydrocarbon oil according to claim 4, wherein said specific hydrocarbon component is a hydrocarbon component having a boiling point within a range from 25 to 360° C.

6. The process for producing a hydrocarbon oil according to claim 4 or claim 5, wherein said multi-stage gas-liquid separator comprises a first gas-liquid separator, a cooling device that cools a gas component separated by said first gas-liquid separator and liquefies at least a portion of said gas component, and a second gas-liquid separator that performs a gas-liquid separation of an outflow from said cooling device, wherein said heavy oil component is a liquid component obtained from said first gas-liquid separator, and said light oil component is a liquid component obtained from said second gas-liquid separator.

* * * * *

UNITED STATES PATENT AND TRADEMARK OFFICE

CERTIFICATE OF CORRECTION

PATENT NO. : 8,702,969 B2
APPLICATION NO. : 13/395264
DATED : April 22, 2014
INVENTOR(S) : Tasaka et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 62 days.

Signed and Sealed this
Twenty-ninth Day of September, 2015

Michelle K. Lee

Michelle K. Lee
*Director of the United States Patent and Trademark Office*